US006027632A

United States Patent [19]

Knall et al.

[11] Patent Number: 6,027,632

[45] Date of Patent: Feb. 22, 2000

[54] MULTI-STEP REMOVAL OF EXCESS EMITTER MATERIAL IN FABRICATING ELECTRON-EMITTING DEVICE

[75] Inventors: N. Johan Knall, Sunnyvale, Calif.; Duane A. Haven, Umpqua, Oreg.; Roger W. Barton, Palo Alto, Calif.; William H. Creel, San Jose, Calif.; Christopher J. Spindt, Menlo Park, Calif.

[73] Assignee: Candescent Technologies Corporation, San Jose, Calif.

[21] Appl. No.: 08/904,967

[22] Filed: Jul. 30, 1997

Related U.S. Application Data

[63] Continuation-in-part of application No. 08/610,729, Mar. 5, 1996, Pat. No. 5,766,446, and a continuation-in-part of application No. 08/884,700, Jun. 30, 1997, Pat. No. 5,893,967.

[51] Int. Cl.[7] ..... C25F 3/02

[52] U.S. Cl. ..... 205/640

[58] Field of Search ..... 205/640

[56] References Cited

U.S. PATENT DOCUMENTS

| | | | |
|---|---|---|---|
| 2,928,777 | 3/1960 | Smith | 204/140.5 |
| 3,174,920 | 3/1965 | Post | 204/143 |
| 3,483,108 | 12/1969 | Schaefer | 204/143 |
| 3,755,704 | 8/1973 | Spindt et al. | 313/309 |
| 4,208,257 | 6/1980 | Hom-ma et al. | 204/129.65 |
| 4,385,971 | 5/1983 | Swartz | 204/129.1 |
| 4,629,539 | 12/1986 | Imai | 204/129.65 |
| 4,857,161 | 9/1989 | Borel et al. | 204/194 |
| 4,952,272 | 8/1990 | Okino et al. | 156/630 |
| 5,188,977 | 2/1993 | Stengl et al. | 437/89 |
| 5,528,103 | 6/1996 | Spindt et al. | 313/497 |
| 5,559,389 | 9/1996 | Spindt et al. | 445/24 |
| 5,564,959 | 10/1996 | Spindt et al. | 445/24 |
| 5,649,847 | 7/1997 | Haven | 445/24 |
| 5,650,690 | 7/1997 | Haven | 313/422 |
| 5,679,044 | 10/1997 | Meyer et al. | 445/24 |
| 5,766,446 | 6/1998 | Spindt et al. | 205/640 |
| 5,863,233 | 1/1999 | Porter et al. | 205/640 |

FOREIGN PATENT DOCUMENTS

| | | |
|---|---|---|
| 0234989 A1 | 9/1987 | European Pat. Off. . |
| 0708473 A1 | 4/1996 | European Pat. Off. . |
| WO 95/07543 | 3/1995 | WIPO . |
| WO 96/06443 | 2/1996 | WIPO . |

OTHER PUBLICATIONS

Brodie et al, "Vacuum Microelectronics," *Advances In Electronics and Electron Physics,* vol. 83, 1992, pp. 1–106.

Spindt et al, "Research in Micron–Size Field–Emission Tubes," *IEEE Conf. Record, 1966 Eighth Conf. on Tube Techniques,* Sep. 20–22, 1966, pp. 143–147.

Vaudaine et al, "'Microtips' Fluorescent Display," *Technical Digest,* 1991 International Electron Devices Meeting, Dec. 8–11, 1991, pp. 8.1.1–8.1.4.

*Primary Examiner*—Donald R. Valentine

*Attorney, Agent, or Firm*—Skjerven, Morrill, MacPherson, Franklin & Friel LLP; Ronald J. Meetin

[57] ABSTRACT

Excess emitter material (52B) is removed in multiple steps during the fabrication of an electron-emitting device. A structure is initially provided in which a dielectric layer (44) overlies a non-insulating region (42), control electrodes (80 or 46/80) overlie the dielectric layer, openings (48/50) extend through the control electrodes and dielectric layer, electron-emissive elements (52A) formed with emitter material are situated in the openings, and an excess layer (52B) of the emitter material overlies the control electrodes and the dielectric layer. Portions of the excess emitter material overlying the dielectric layer in the spaces between the control electrodes are initially removed, preferably with etchant that directly attacks the emitter material. Portions (52C) of the excess emitter material overlying the control electrodes above the electron-emissive elements are subsequently removed to expose the electron-emissive elements.

22 Claims, 7 Drawing Sheets

MULTI-STEP REMOVAL OF EXCESS EMITTER MATERIAL IN FABRICATING ELECTRON-EMITTING DEVICE

CROSS-REFERENCE TO RELATED APPLICATIONS

This is continuation-in-part of Spindt et al, U.S. patent application Ser. No. 08/610,729, filed Mar. 5, 1996 now U.S. Pat. No. 5,766,466. This is also a continuation-in-part of Knall et al, U.S. patent application Ser. No. 08/884,700, filed Jun. 30, 1997, now U.S. Pat. No. 5,893,967. The contents of Spindt et al and Knall et al are incorporated by reference to the extent not repeated herein.

FIELD OF USE

This invention relates to the fabrication of electron emitters devices, especially electron-emitters employed in flat-panel cathode-ray tube ("CRT") displays of the field-emission type.

BACKGROUND ART

A field-emission cathode (or field emitter) contains a group of electron-emissive elements that emit electrons upon being subjected to an electric field of sufficient strength. The electron-emissive elements are typically situated over a patterned layer of emitter electrodes. In a gated field emitter, a patterned gate layer typically overlies the patterned emitter layer at the locations of the electron-emissive elements. Each electron-emissive element is exposed through an opening in the gate layer. When a suitable voltage is applied between a selected portion of the gate layer and a selected portion of the emitter layer, the gate layer extracts electrons from the electron-emissive elements at the intersection of the two selected portions.

The electron-emissive elements are often shaped as cones. Referring to the drawings, FIGS. 1*a*–1*d* illustrate a conventional technique as, for example, disclosed in Spindt et al, U.S. Pat. No. 3,755,704, for creating conical electron-emissive elements in a gated field emitter for a flat-panel CRT display. At the stage shown in FIG. 1*a*, the partially finished field emitter consists of an electrically insulating substrate 20, an emitter electrode layer 22, an intermediate dielectric layer 24, and a gate layer 26. Gate openings 28 extend through gate layer 26. Corresponding, somewhat wider dielectric openings 30 extend through dielectric layer 24.

Using a grazing-angle deposition procedure, a lift-off layer 32 is formed on top of gate layer 26 as depicted in FIG. 1*b*. Emitter material is deposited on top of the structure and into dielectric openings 30 in such a way that the apertures through which the emitter material enters openings 30 progressively close. In U.S. Pat. No. 3,755,704, a closure material is simultaneously deposited at a grazing angle to help close the deposition apertures. Generally conical electron-emissive elements 34A are thereby formed in composite openings 28/30 over emitter layer 22. See FIG. 1*c*. A continuous layer 34B of the emitter/closure material forms on top of gate layer 26. Lift-off layer 32 is subsequently removed with a suitable etchant to lift off (i.e., remove) excess emitter/closure-material layer 34B. FIG. 1*d* shows the resultant structure.

Removing lift-off layer 32 in order to lift off excess emitter/closure-material layer 34B is typically adequate when (a) the topography of the structure below lift-off layer 32 is smooth and (b) excess emitter/closure-material layer 34B is porous so that the lift-off etchant can readily penetrate excess layer 34B to attack lift-off layer 32. However, gate layer 26 is usually a patterned layer consisting of multiple laterally separated portions that cause significant roughness in the topography of the structure below lift-off layer 32. Parts of layer 32 sometimes remain in the spaces between the portions of gate layer 26, especially when the gate portions are close together.

Also, due to the surface roughness, the initial thickness of lift-off layer 32 is non-uniform. In particular, the non-uniformity is frequently so great that portions of the lift-off material do not initially accumulate at certain areas in the spaces between the gate portions. Portions of excess layer 34B are directly attached to gate layer 26 and/or dielectric layer 24 at these areas, and are therefore not lifted off during the removal of lift-off layer 32. The net result is that pieces of excess layer 34B often remain in the spaces between the gate portions. This can lead to short circuiting between the portions of gate layer 26.

If excess emitter/closure-material layer 34B is not porous, the etchant can access lift-off layer 32 only through pin holes and at the edges of the structure. The etch time often becomes excessively long. It is desirable to remove excess layer 34B rapidly and in a way that avoids short circuiting concerns.

GENERAL DISCLOSURE OF THE INVENTION

The present invention furnishes such a removal technique. In the invention, portions of a layer of excess emitter material are removed in multiple steps during fabrication of an electron-emitting device. In a first step, excess emitter material is removed from regions of the device where the presence of pieces of the emitter material could be damaging to device operation. The first removal step is typically done with etchant that directly attacks the emitter material so as to remove substantially all of the excess emitter material intended to be removed during the step. Also, the etchant is normally brought essentially simultaneously into contact with largely all of the exterior surface area of the excess emitter material being removed. Consequently, the first removal step is performed rapidly.

In a subsequent step, portions of the excess emitter material are removed at regions where the presence of small amounts of the emitter material is usually of little consequence. By utilizing this multi-step procedure, the invention avoids the short-circuiting concerns that arise when a lift-off layer is employed to remove all the excess emitter material in a single step.

More particularly, a fabrication process in accordance with the invention entails providing an initial structure in which (a) a group of control electrodes overlie a dielectric layer, (b) a multiplicity of electron-emissive elements comprising electrically non-insulating emitter material are respectively situated largely in dielectric openings extending through the dielectric layer and are exposed through control apertures extending through the control electrodes, and (c) an excess layer comprising the emitter material overlies the control electrodes and the portions of the dielectric layer at the spaces between the control electrodes. Portions of the excess emitter material overlying the dielectric layer in the spaces between the control electrodes are removed in a first removal step, preferably with etchant that directly attacks the emitter material. Subsequently, portions of the excess emitter material overlying the control electrodes above the electron-emissive elements are removed in a second removal step to expose the electron-emissive elements.

In addition to alleviating the above-mentioned short circuiting concerns, removing the excess emitter material according to the invention's teachings provides flexibility to the fabrication process. During the interval between the two removal steps at the point in the process where parts of the layer of excess emitter material overlie the electron-emissive elements and thereby prevent them from being contaminated or damaged, certain desirable features can be formed at the areas where the emitter material has been removed during the first removal step. For example, portions of a focusing structure can be formed in the spaces between the control electrodes during the interval between the two removal steps. The focusing structure is employed in focusing electrons emitted by the electron-emissive elements.

During the second removal step, the excess emitter material overlying the electron-emissive elements can be removed by a lift-off technique. Because the excess emitter material has already been removed from the regions between the control electrodes, an incomplete lift off at this point in the fabrication process typically does not result in significant short circuiting between the control electrodes. Alternatively, the excess emitter material overlying the electron-emissive elements can be electrochemically removed, thereby totally avoiding the need for a lift-off layer. The net result is that the fabrication process of the invention provides great flexibility in manufacturing electron-emitting devices while overcoming major short circuiting problems.

BRIEF DESCRIPTION OF THE DRAWINGS

Like reference symbols are employed in the drawings and in the description of the preferred embodiments to represent the same, or very similar, item or items.

DESCRIPTION OF THE PREFERRED EMBODIMENTS

Figure 1A:
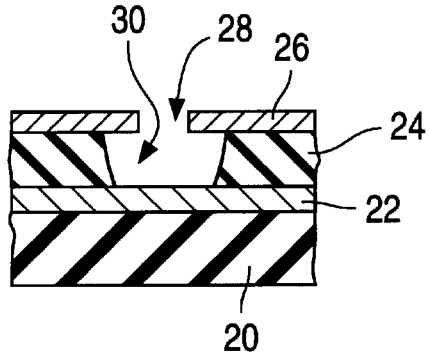
Fig. 1a PRIOR ART
FIGS. 1*a*–1*d* are cross-sectional structural views representing steps in a prior art process for creating electron-emissive elements in an electron emitter.
Figure 1B:
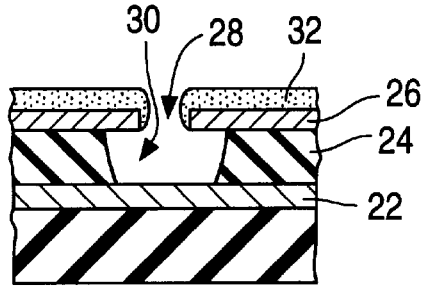
Fig. 1b PRIOR ART
Figure 1C:
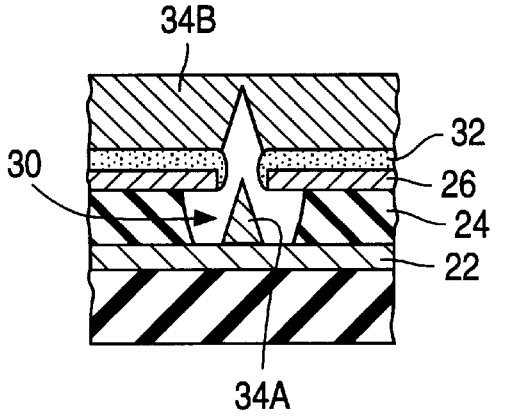
Fig. 1c PRIOR ART
Figure 1D:
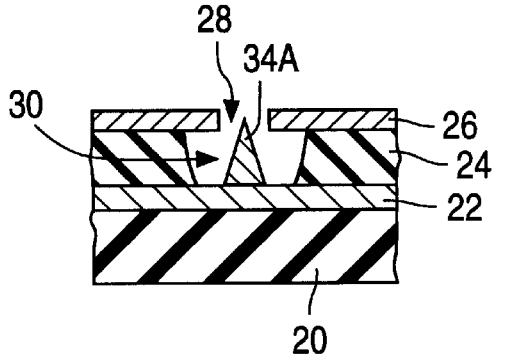
Fig. 1d PRIOR ART

The present invention utilizes a two-step technique for removing excess emitter material in creating electron-emissive elements for a gated field-emission cathode. Each such field emitter is suitable for exciting phosphor regions on a faceplate in a cathode-ray tube of a flat-panel display such as a flat-panel television or a flat-panel video monitor for a personal computer, a lap-top computer, or a workstation.

In the following description, the term "electrically insulating" or "dielectric" generally applies to materials having a resistivity greater than $10^{10}$ ohm-cm. The term "electrically non-insulating" thus refers to materials having a resistivity below $10^{10}$ ohm-cm. Electrically non-insulating materials are divided into (a) electrically conductive materials for which the resistivity is less than 1 ohm-cm and (b) electrically resistive materials for which the resistivity is in the range of 1 ohm-cm to $10^{10}$ ohm-cm. Similarly, the term "electrically non-conductive" refers to materials having a resistivity of at least 1 ohm-cm, and includes electrically resistive and electrically insulating materials. These categories are determined at an electric field of no more than 1 volt/$\mu$m.

FIGS. 2*a*–2*d* (collectively "FIG. 2") illustrate a process sequence for removing excess emitter material in accordance with the invention during the creation of electron-emissive elements for a gated field emitter of a flat-panel CRT display. The starting point in the process sequence of FIG. 2 is an electrically insulating substrate 40 typically formed with ceramic or glass. See FIG. 2*a*. Substrate 40, which provides support for the field emitter, is configured as a plate. For example, substrate 40 typically consists of a plate of Schott D263 glass having a thickness of approximately 1 mm.

A lower electrically non-insulating emitter region 42 overlies substrate 40. Lower non-insulating region 42 contains an electrically conductive layer patterned into a group of laterally separated emitter electrodes. Letting the direction of the rows of picture elements (pixels) in the flat-panel CRT display be referred to as the row direction, the emitter electrodes of region 42 extend generally parallel to one another in the row direction so as to constitute row electrodes. The emitter electrodes typically consist of metal such as aluminum or nickel. The thickness of the emitter electrodes is 100–500 nm, typically 200 nm.

An electrically resistive layer typically overlies the emitter electrodes in lower non-insulating region 42. Candidate materials for the resistive layer include cermet (ceramic with embedded metal particles) and silicon-carbon-nitrogen compounds. The resistive layer provides a resistance of at least $10^6$ ohms, typically $10^{10}$ ohms, between each electron-emissive element and the underlying emitter electrode.

An electrically insulating layer 44, which serves as the interelectrode dielectric, is provided on top of non-insulating region 42. The thickness of insulating layer 44 is normally 0.05–3 $\mu$m, preferably 100 nm–500 nm, typically 150 nm. Insulating layer 44 typically consists of silicon oxide or silicon nitride. Although not shown in FIG. 2*a*, parts of insulating layer 44 may contact substrate 40 depending on the configuration of non-insulating region 42.

A patterned electrically non-insulating gate layer 46 consisting of selected gate material is situated on interelectrode dielectric layer 44. Gate layer 46 normally has a thickness of 30–500 nm, preferably 30–100 nm, typically 40 nm. The gate material is normally metal, preferably chromium. Alternative candidates for the gate material include molybdenum, platinum, niobium, tantalum, titanium, gold, nickel, tungsten, and titanium-tungsten. Gate layer 46 can also be formed with a combination of two or more of these materials.

Gate layer 46 may be patterned in various ways. Preferably, gate layer 46 is configured as multiple generally parallel, laterally separated lines that extend perpendicular to the row electrodes of emitter region 42. Each of the gate layer lines is typically divided into plural laterally separated segments. A multiplicity of generally circular openings 48 extend through gate layer 46. Although the diameters of gate openings 48 depend on how openings 48 are created, the gate opening diameter is normally 0.05–2 $\mu$m, preferably 80–400 nm, typically 150 nm.

Figure 2A:
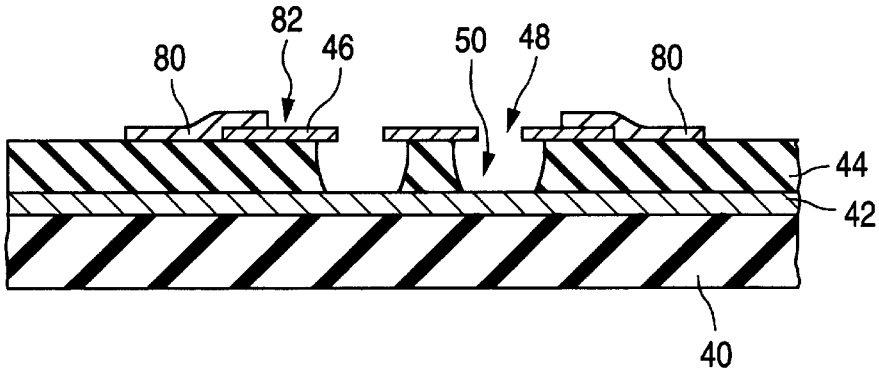
FIGS. 2*a*–2*d* are cross-sectional views representing steps in a process sequence according to the invention for creating conical electron-emissive elements in a gated field emitter.

A multiplicity of generally circular dielectric openings (or dielectric open spaces) 50 extend through insulating layer 44 down to lower non-insulating emitter region 42. Dielectric openings 50 are allocated into multiple laterally separated sets of openings 50. FIG. 2*a* depicts one such set of openings 50. Each set of openings 50 overlies a selected portion of one of the emitter electrodes in region 42.

Each dielectric opening 50 is vertically aligned to a corresponding one of gate openings 48 to form a composite opening 48/50 that exposes part of region 42. Each dielectric open space 50 is somewhat wider than corresponding gate opening 48. Consequently, insulating layer 44 undercuts gate layer 46 along composite openings 48/50.

Various techniques can be employed to form composite openings 48/59 in layers 44 and 46. For example, openings 48/50 can be created by etching gate layer 46 through apertures in a mask, typically photoresist, to form gate openings 48 and then etching insulating layer 44 through opening 48 to create dielectric open spaces 50. Composite openings 48/50 can be created by using etched charged-particle tracks as described in Macaulay et al, PCT Patent Publication WO 95/97543. Subject to different nomenclature and different materials, openings 48/50 can also be formed according to a sphere-based procedure of the type described in Spindt et al, "Research in Micron-Size Field-Emission Tubes, " *IEEE Conf. Rec.* 1966 *Eighth Conf. on Tube Techniques,* Sep. 20, 1966, pages 143–147.

A group of laterally separated main control electrodes 80 are situated on top of the structure above dielectric layer 44 and extend generally perpendicular to the emitter electrodes of non-insulating region 42. One such main control electrode 80 is depicted in FIG. 2*a*. Letting the direction of the columns of pixels in the flat-panel display be referred to as the column direction, control electrodes 80 thus extend in the column direction so as to constitute main column electrodes.

Each main control electrode 80 adjoins part of gate layer 46. In the preferred case where gate layer 46 is configured as lines extending in the column direction, each control electrode 80 overlies portions of a corresponding one of the gate lines along its outer longitudinal edges. When each gate line is divided into multiple segments laterally separated in the column direction, each control electrode 80 extends down to dielectric layer 44 in the spaces between the segments of the corresponding gate line. Rather than partially overlying gate layer 46, electrodes 80 can partially underlie layer 46. In either case, the combination of a main control electrode 80 and the adjoining portion(s) of gate layer 46 forms a composite control electrode 46/80 extending in the column direction.

A group of main control apertures 82, one of which is shown in FIG. 2*a*, extend through each main control electrode 80 down to the underlying parts of gate layer 46. Each control aperture 82 is situated above a corresponding one of the sets of dielectric openings 50. Consequently, control apertures 82 expose composite openings 48/50.

Figure 2B:
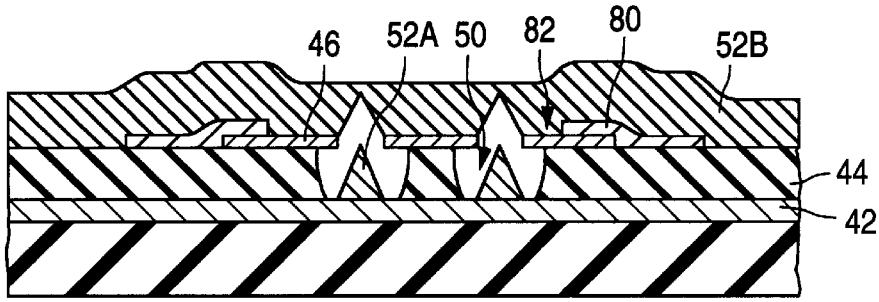

Referring to FIG. 2*b*, electrically non-insulating emitter cone material is evaporatively deposited on top of the structure in a direction generally perpendicular to the upper surface of insulating layer 44 (or gate layer 46). The emitter cone material accumulates on the exposed portions of gate layer 46 and passes through gate openings 48 to accumulate on lower non-insulating region 42 in dielectric open spaces 50. Due to the accumulation of the cone material on gate layer 46, the openings through which the cone material enters open spaces 50 progressively close. The deposition is performed until these openings fully close. As a result, the cone material accumulates in dielectric open spaces 50 to form corresponding conical electron-emissive elements 52A.

In addition to accumulating on gate layer 46, the emitter cone material simultaneously accumulates on main control electrodes 80 and on the exposed material of dielectric layer 44. A continuous (blanket) layer 52B of the cone material is thus formed on top of the structure.

The emitter cone material is normally metal, preferably molybdenum when gate layer 46 consists of chromium. Alternative candidates for the cone material include nickel, chromium, platinum, niobium, tantalum, titanium, tungsten, titanium-tungsten, and titanium carbide subject to the cone material differing from the gate material when an electrochemical technique is later employed to remove one or more portions of layer 52B formed with the excess emitter material.

A photoresist mask (not shown) is formed on top of excess emitter-material layer 52B. The photoresist mask has solid masking portions which are situated fully above control apertures 82 and extend partially above adjoining portions of main control electrodes 80. Preferably, each solid masking portion is generally in the shape of a rectangle that overlies a corresponding single one of control apertures 82 and is laterally separated from masking portions that overlie the other control apertures 82 in the same control electrode 80.

Figure 2C:
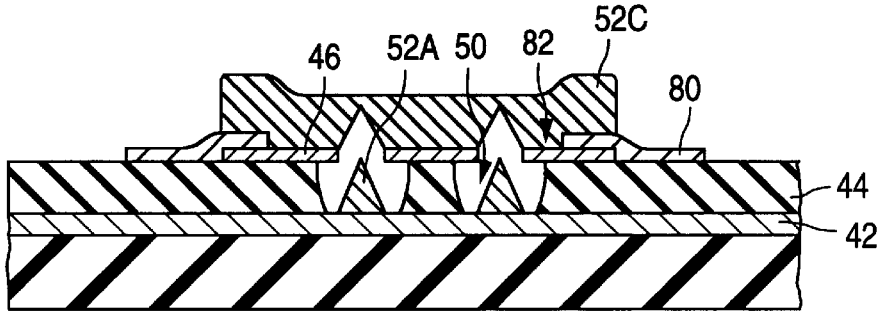

The material of excess layer 52B exposed through the photoresist mask is removed with a suitable etchant. In particular, the excess emitter material that occupies the spaces between main control electrodes 80 is etched away down to dielectric layer 44. Portions of the excess emitter material overlying the longitudinal edges of control electrodes 80 are normally removed during the selective etch along with one or more portions of the excess emitter material situated in the lateral periphery of the field emitter, i.e., outside the active area. FIG. 2*c* depicts the resultant structure in which item 52C is the patterned remainder of excess emitter-material layer 52B.

Figure 3A:
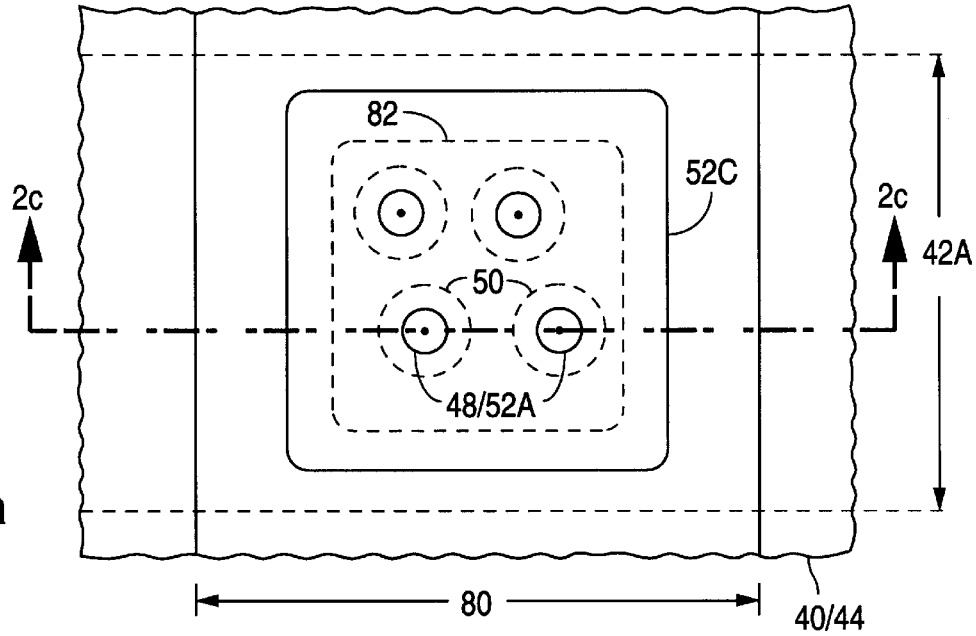
FIGS. 3*a* and 3*b* are layout views of the respective structures in FIGS. 2*c* and 2*d*. The cross section of FIG. 2*c* is taken through plane 2*c*—2*c* in FIG. 3*a*. The cross section of FIG. 2*d* is taken through plane 2*d*—2*d* in FIG. 3*b*.

Excess emitter-material remainder 52C preferably consists of a group of rectangular islands that respectively extend fully across, and thus fully occupy, control apertures 82. A preferred layout (plan) view of FIG. 2*c* is shown in FIG. 3*a*. Item 42A in FIG. 3*a* indicates a typical emitter electrode in non-insulating region 42. By using the same reticle to create the photoresist mask employed in defining emitter-material islands 52C as utilized in patterning gate layer 46, the outside boundary of each excess emitter-material island 52C is approximately in vertical alignment with the outside boundary of the underlying portion of layer 46.

The etchant utilized to define excess emitter-material islands 52C directly attacks the exposed emitter material. The etchant is brought virtually simultaneously into contact with largely the entire section of the external (outside) surface of excess layer 52B where the excess emitter material is being removed here, thereby enabling islands 52C to be defined rapidly. The selective etch is performed for a duration sufficient to remove virtually all of the exposed emitter material. When the emitter material consists of molybdenum, the exposed molybdenum is typically removed with a chemical (wet) etchant consisting of 16 parts phosphoric acid, 1 part acetic acid, 1 part nitric acid, and 2 parts water. The etch is conducted for 40–300 sec., typically 90 sec., at 15–50° C., typically 40° C.

Various features can now be formed over the areas not covered by excess emitter-material islands 52C.

For example, portions of a system that focuses electrons emitted from electron-emissive elements 52A during display operation can be formed over the uncovered areas of dielectric layer 44.

At this point, a small percentage of electron-emissive cones 52A are typically electrically short circuited to gate layer 46. The short circuiting of a cone 52A can arise from that cone 52A being forced into contact with gate layer 46 or from one or more electrically conductive particles lodging between gate layer 46 and that cone 52A. To the extent that any such electrical shorts are present in the final flat-panel display, the display power consumption is normally increased slightly. However, due to the presence of the resistive layer in lower non-insulating region 42, the current that flows through each such short circuit is normally so low as to not produce any other significant deterioration in display performance.

An electrochemical removal operation is performed to remove excess emitter-material islands 52C without significantly attacking the vast majority of electron-emissive cones 52A. Specifically, the electrochemical removal of islands 52C is conducted in such a manner that no significant damage occurs to cones 52A not electrically shorted to gate layer 56. Cones 52A which are electrically shorted to gate layer 46 are typically electrochemically attacked until the electrical shorts are eliminated. Depending on how much of the material of a previously shorted cones 52A is removed during the electrochemical removal operation, that cone 52A may sometimes be able to function adequately.

Figure 2D:
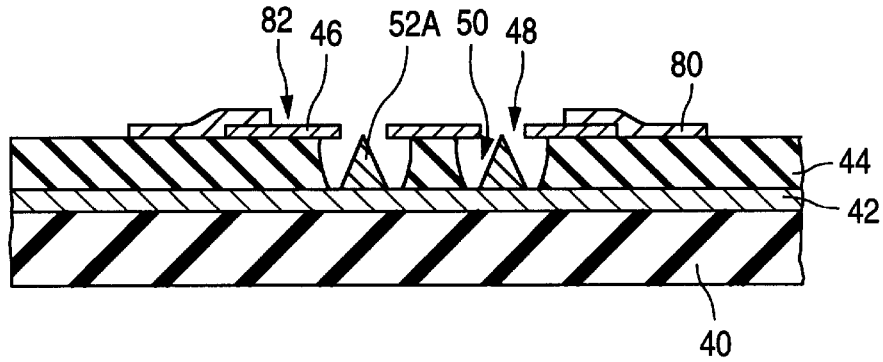
Figure 3B:
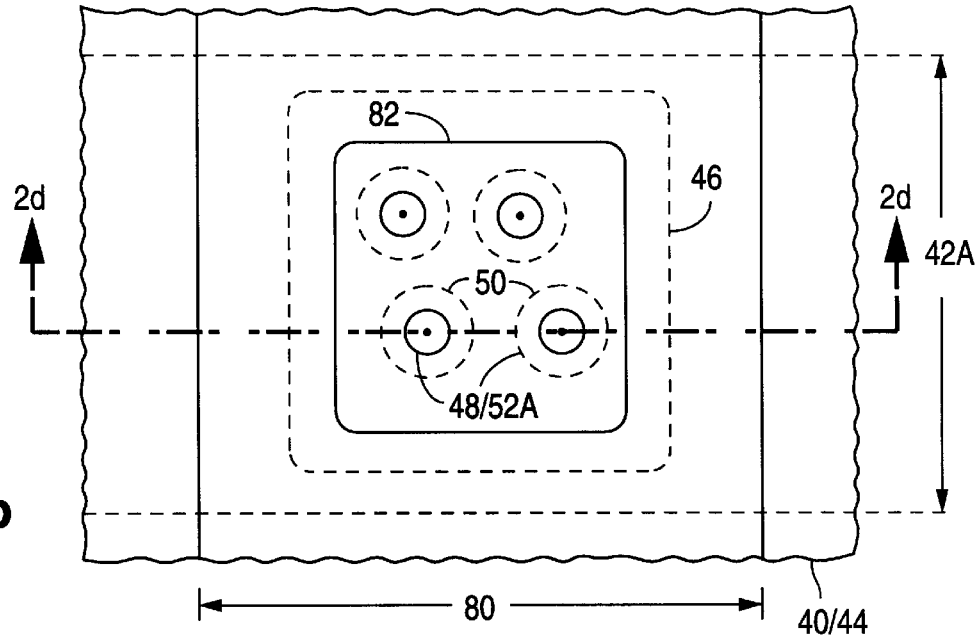

FIG. 2*d* illustrates the field emitter after removal of excess layer 52C. Control apertures 82 have been reopened to expose electron-emissive cones 52A. Gate layer 46 and main control electrodes 82 are substantially intact. That is, neither layer 46 nor electrodes 80 have been substantially electrochemically attacked during the removal of islands 52C. FIG. 3*b* depicts a layout view of FIG. 2*d*.

Instead of removing islands 52C electrochemically, islands 52C can be removed according to a lift-off technique. In the lift-off case, a lift-off layer is provided on top of gate layer 46, main control electrodes 80, and dielectric layer 44 at the stage shown in FIG. 2*a*. The lift-off layer is typically created by evaporating a suitable lift-off material at a relatively small angle, typically in the vicinity of 30°, to the upper surface of dielectric layer 44 (or gate layer 46). At the stage of FIG. 2*b*, the lift-off layer lies directly below excess emitter-material layer 52B.

To facilitate the lift off, excess layer 52B is created in such a manner that the lift-off etchant can readily penetrate (the entire thickness of) layer 52B to attack the lift-off layer. For this purpose, molybdenum is a suitable metal for cones 52A and excess layer 52B.

Part of the lift-off layer is exposed during the selective etch of excess emitter-material layer 52B to form islands 52C. Depending on various factors, this part of the lift-off layer can be left in place at this point or immediately removed. Upon reaching the point at which islands 52C are to be removed, a suitable etchant is employed to remove the lift-off material underlying islands 52C along with any other lift-off material overlying the structure. Islands 52C are thereby removed to produce the structure of FIGS. 2*d*.

FIGS. 4*a*–4*e* (collectively "FIG. 4") illustrate another process sequence in which excess emitter material is removed in accordance with the invention during the creation of electron-emissive elements for a gated field emitter of a flat-panel CRT display. In the process sequence of FIG. 4, the field emitter is also furnished with a system for focusing electrons emitted by the electron-emissive elements during display operation when a suitable light-emitting device is situated opposite the field emitter. FIGS. 5*a*–5*d* present layout views of the field emitter at the respective fabrication stages shown in FIGS. 4*a* and 4*c*–4*e*.

The starting point for the process sequence of FIG. 4 is a partially finished field-emission structure consisting of substrate 40, lower non-insulating region 42, and insulating layer 44 arranged as described above. See FIGS. 4*a* and 5*a*. A group of laterally separated main control electrodes 80 are situated over insulating layer 44 in the field emitter of FIG. 4*a* and extend in the column direction. Two such control electrodes 80 are shown in FIG. 4*a*. In contrast to the field emitter manufactured according to the process of FIG. 2 where control electrodes 80 partially overlie gate layer 46, control electrodes 80 in FIG. 4*a* are situated fully on the top of dielectric layer 44. Control apertures 82 again extend through control electrodes 80. One control aperture 82 is depicted in FIG. 4*a* for each illustrated control electrode 80.

An electrically non-insulating gate layer 46P consisting of selected gate material is situated on top of the structure. Specifically, gate layer 46P overlies main control electrodes 80 and extends into control apertures 82 and into the spaces between electrodes 80 down to insulating layer 44. A multiplicity of openings 48 extend through the portion of gate layer 46P situated in each control opening 82. Aside from gate openings 48, gate layer 46P is unpatterned, i.e., a blanket layer. An opening 50 extends through dielectric layer 44 below each gate opening 48 to form a composite opening 48/50.

Figure 4A:
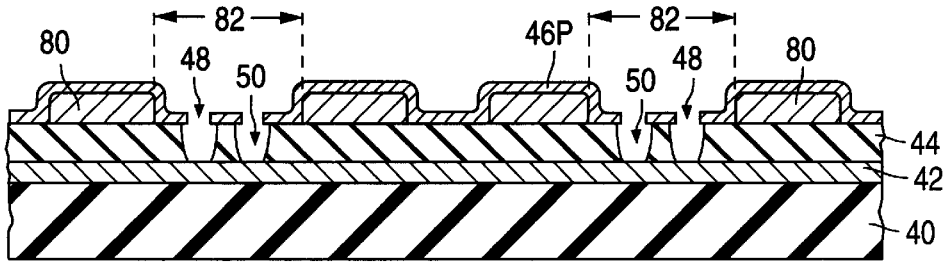
FIGS. 4*a*–4*e* are cross-sectional views representing steps in a process sequence according to the invention for creating conical electron-emissive elements and a focusing system in a gated field emitter.

Aside from slight differences in the control-electrode configuration, components 40, 42, 44, and 80 in the partially finished field emitter of FIG. 4*a* are created from the same materials and have the same characteristics as described above. Except for being essentially unpatterned, blanket gate layer 46P is likewise formed from the same material and has the same characteristics as patterned gate layer 46. Openings/apertures 48, 50, and 82 have the above-described characteristics.

Figure 4B:
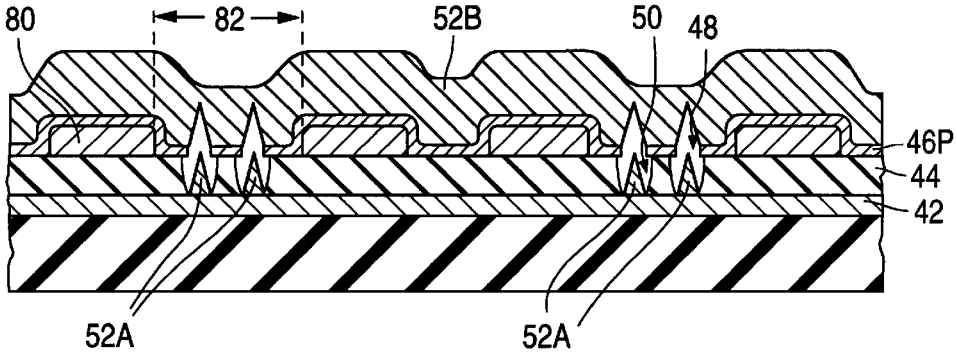

Electrically non-insulating emitter cone material is evaporatively deposited on top of the structure of FIG. 4*a* in the manner described above for the process of FIG. 2. The cone material thereby accumulates in dielectric openings 50 to form conical electron-emissive elements 52A as shown in FIG. 4*b*. Continuous excess layer 52B of the cone material is simultaneously formed on blanket gate layer 46P.

A photoresist mask (not shown) typically having the same pattern as the photoresist mask utilized to pattern excess emitter-material layer 52B in the process of FIG. 2 is formed on top of excess layer 52B in FIG. 4*b*. The material of layer 52B exposed through the photoresist mask is removed with an etchant that directly attacks the exposed emitter material. The selective etch to pattern layer 52B is performed in the way described above. The remainder of excess emitter-material layer 52B again consists of islands 52C. The etchant is typically a chemical etchant and therefore has an isotropic component. Consequently, excess emitter-material islands 52C undercut the photoresist mask slightly. Portions of gate layer 46P are now exposed.

Figure 4C:
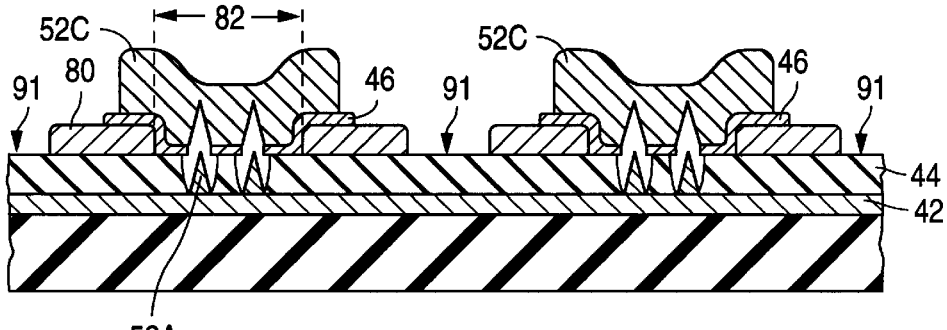
Figure 5A:
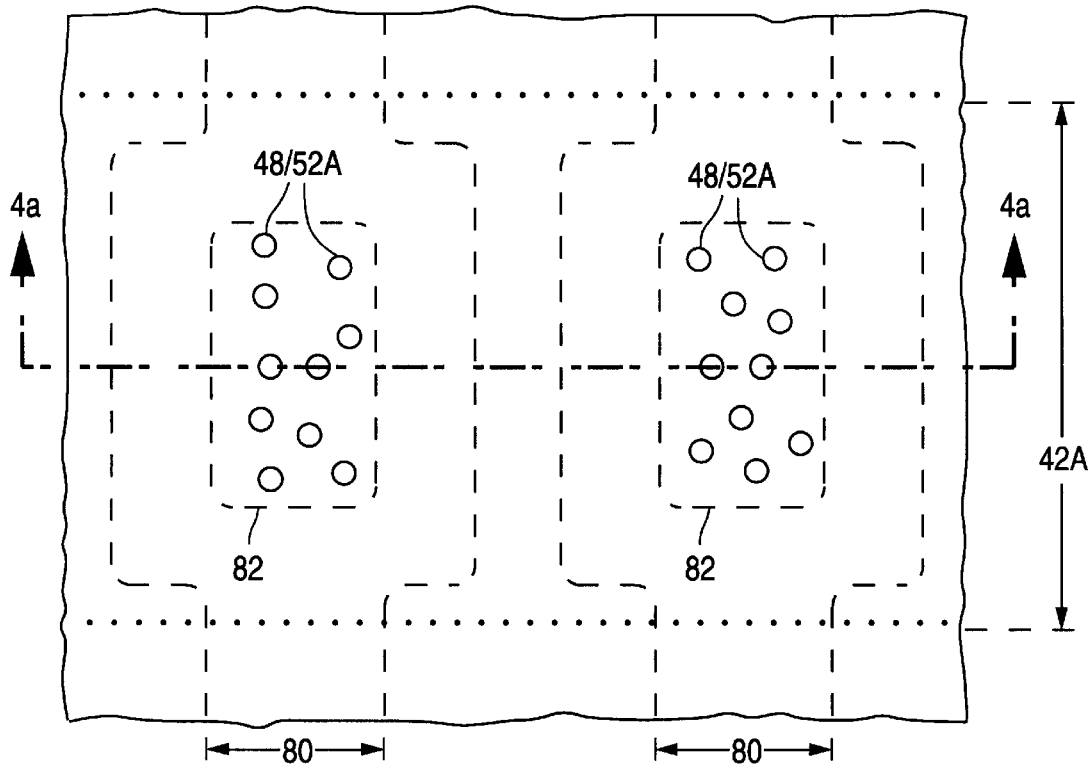
FIGS. 5*a*–5*d* are layout view of the respective structures in FIGS. 4*a* and 4*c*–4*e*. The cross section of FIG. 4*a* is taken through plane 4*a*—4*a* in FIG. 5*a*. The cross sections of FIGS. 4*c*–4*e* are similarly respectively taken through planes 4*c*—4*c*, 4*d*—4*d*, and 4*e*—4*e* in FIGS. 5*b*–5*d*.
Figure 5B:
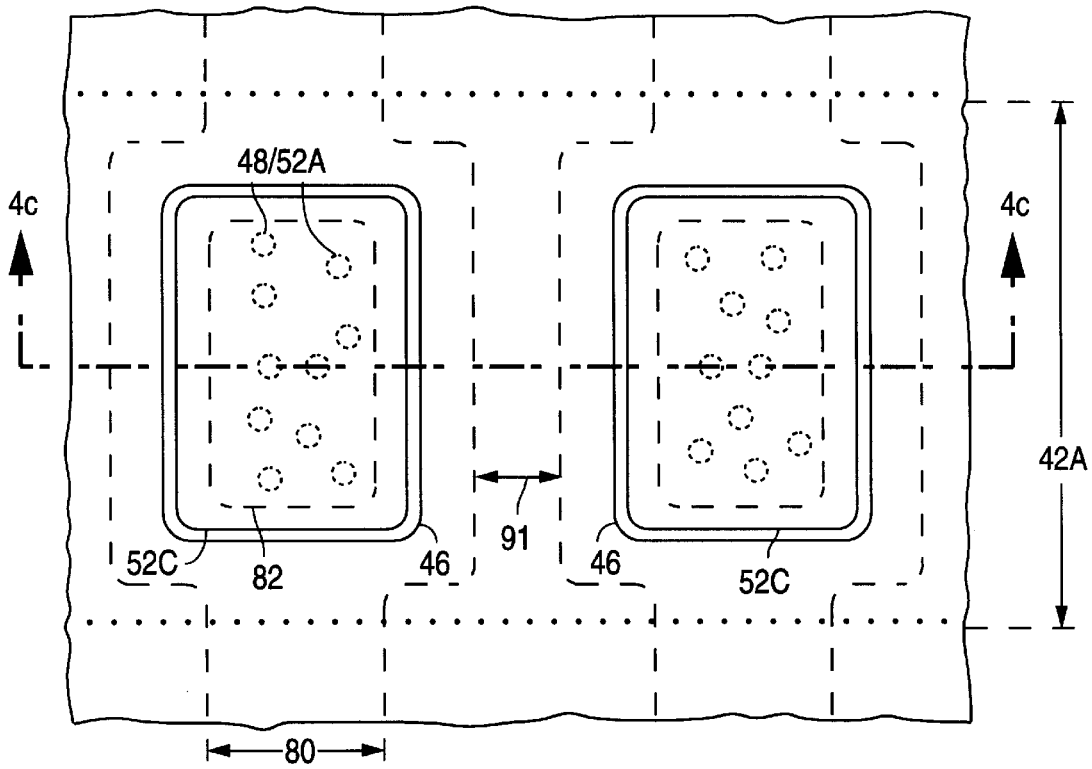
Figure 5C:
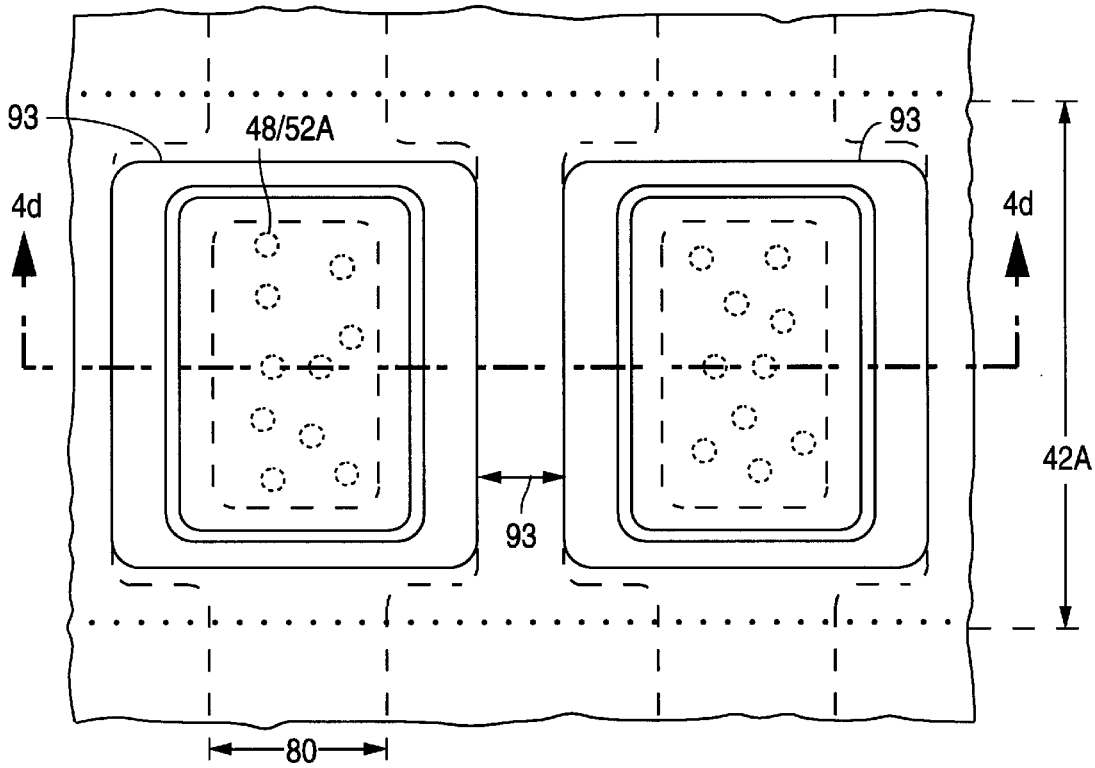

With the photoresist mask in place, blanket gate layer 46P is selectively etched to produce patterned gate layer 46. The gate etch is usually performed with a largely anisotropic etchant, typically a chlorine plasma, in a direction generally perpendicular to the upper surface of dielectric layer 44 so that gate layer 46 does not significantly undercut the photoresist mask. FIGS. 4*c* and 5*b* depict the resultant structure after removing the photoresist. Since an etchant with an isotropic component was employed in selectively etching excess emitter-material layer 52B whereas a fully anisotropic etchant was utilized in selectively etching blanket gate layer 46P through the same photoresist mask, the resulting portions of gate layer 46 respectively extend laterally outward slightly beyond excess emitter-material islands 52C.

Alternatively, blanket gate layer 46P can be patterned with an etchant having an isotropic component to reduce or substantially eliminate the lateral extension of gate portions 46 beyond islands 52C. In either case, insulating layer 44 is now exposed at areas 91.

Figure 4D:
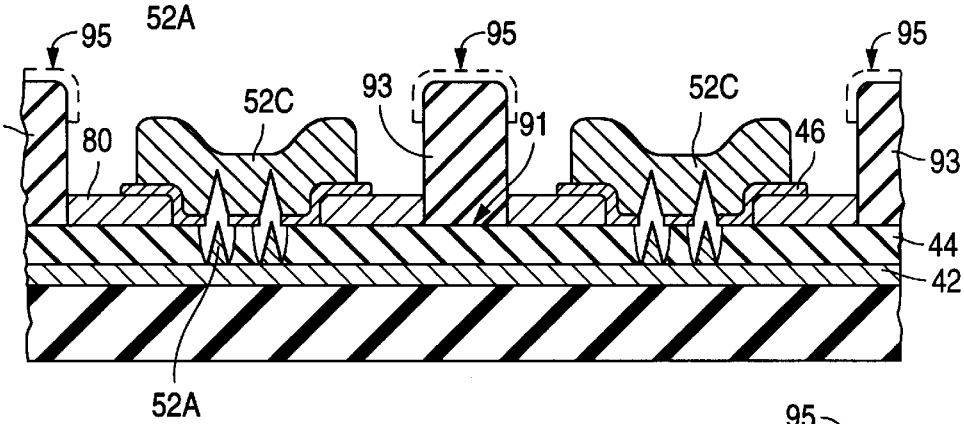

An electrically non-conductive base focusing structure 93 for a system that focuses electrons emitted by cones 52A is formed on top of the partially finished field emitter as shown in FIG. 4*d*. Base focusing structure 93 is generally arranged in a waffle-like pattern as viewed perpendicularly to the upper surface of substrate 40. See FIG. 5*c*. In the row direction, portions of focusing structure 93 typically occupy the spaces above exposed areas 91 of insulating layer 44. In the column direction, focusing structure 93 typically passes over main control electrodes 80 outside control apertures 82. Consequently, apertures 82 are exposed through respective openings in structure 93.

Base focusing structure 93 normally consists of electrically insulating material but can be formed with electrically resistive material of sufficiently high resistivity as to not cause control electrodes 80 to be electrically coupled to one another. Typically, focusing structure 93 is formed with actinic material that has been selectively exposed to suitable actinic radiation and developed to remove either the unexposed actinic material or the unexposed actinic material. Exposure to the actinic radiation causes the exposed actinic material to change chemical structure. The actinic material is typically photopolymerizable polyimide such as Olin OCG7020 polyimide. Focusing structure 93 typically extends 45–50 $\mu$m above insulating layer 44.

Various techniques can be employed to form base focusing structure 93. For instance, focusing structure 93 can be formed according to the backside/frontside actinic-radiation exposure procedure described in Haven, U.S. Pat. Nos. 5,649,847 or 5,650,690, the contents of which are incorporated by reference. Structure 93 can also be created according to the backside/frontside actinic-radiation procedure disclosed in Spindt et al, U.S. patent application Ser. No. 08/866,150, filed May 30, 1997, the contents of which are incorporated by reference. In this case, the emitter electrodes in non-insulating region 42 are typically in the shape of ladders as viewed perpendicularly to substrate 40. Focusing structure 93 can also be formed according to a procedure that employs only frontside actinic-radiation exposure.

The electron focusing system includes a thin electrically non-insulating focus coating 95 provided over base focusing structure 93. Focus coating 95 normally consists of electrically conductive material, typically a metal such as aluminum having a thickness of 100 nm. The sheet resistance of focus coating 95 is typically 1–10 ohms/sq. In certain applications, focus coating 95 can be formed with electrically resistive material. In any event, the resistivity of focus coating 95 is normally considerably less than that of base focusing structure 93.

Focus coating 95 can be formed at various points in the fabrication process. Coating 95 is typically created after excess emitter-material layer 52C is removed. However, coating 95 can be formed before removing excess layer 52C as indicated by the dashed lines used to indicate coating 95 in FIG. 4*d*. Provided that coating 95 is appropriately electrically isolated from composite control electrodes 46/80, coating 95 can be created in various ways. For example, coating 95 can be formed by a low-angle evaporative deposition as described in Haven et al, U.S. patent application Ser. No. 08/866,544, filed May 30, 1997, the contents of which are incorporated by reference.

With at least component 93 of the electron focusing system having been formed, excess emitter-material layer 52C is removed. The removal of excess layer 52C is preferably done electrochemically in the manner described above. Layer 52C can also be removed according to a lift-off technique in the alternative manner described above. If focus coating 95 is not yet incorporated into the electron focusing structure, coating 95 is now formed over focusing structure 93. The resultant field-emission structure is shown in FIGS. 4*e* and 5*d*.

The flat-panel CRT display is typically a color display in which each pixel consists of three sub-pixels, one for red, another for green, and the third for blue. Typically, each pixel is approximately square as viewed perpendicularly to substrate 40 with the three sub-pixels laid out as rectangles situated side by side in the row direction with the long axes of the rectangles oriented in the column direction. In this sub-pixel layout, electron focus control is normally more critical in the row direction than in the column direction.

The set of electron-emissive elements 52A in each control aperture 82 provide electrons for one sub-pixel. The control apertures 82 in each composite control electrode 46/80 are arranged to be centered on that electrode 46/80 in the row direction. By arranging for edges of electron focusing system 93/95 to be approximately aligned vertically with the longitudinal edges of composite control electrodes 46/80 in the manner depicted in FIGS. 4*e* and 5*d*, excellent focus control is achieved in the row direction. Opening areas 91 during the selective etch of excess emitter-material layer 52B to form islands 52C permits this vertical alignment to be attained and thus enables the desired focus control to be achieved.

Figure 4E:
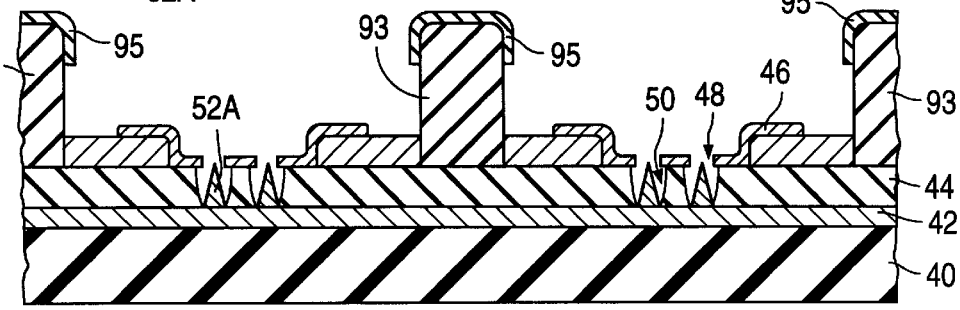
Figure 5D:
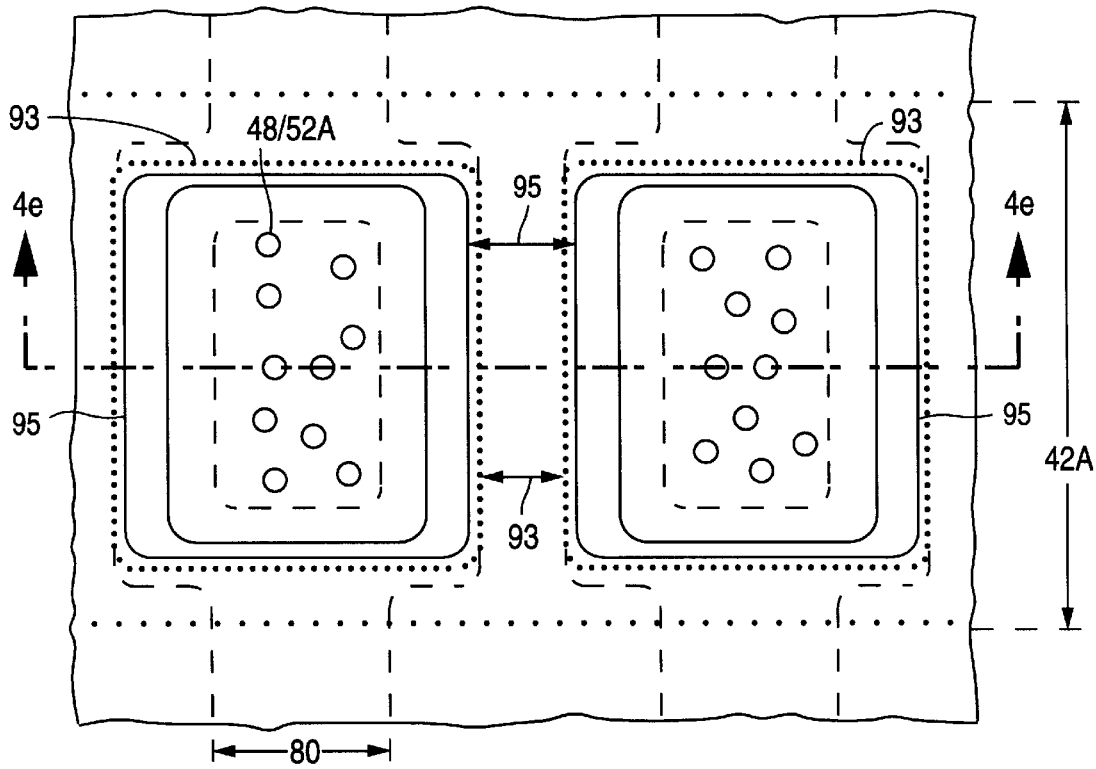
Figure 6:
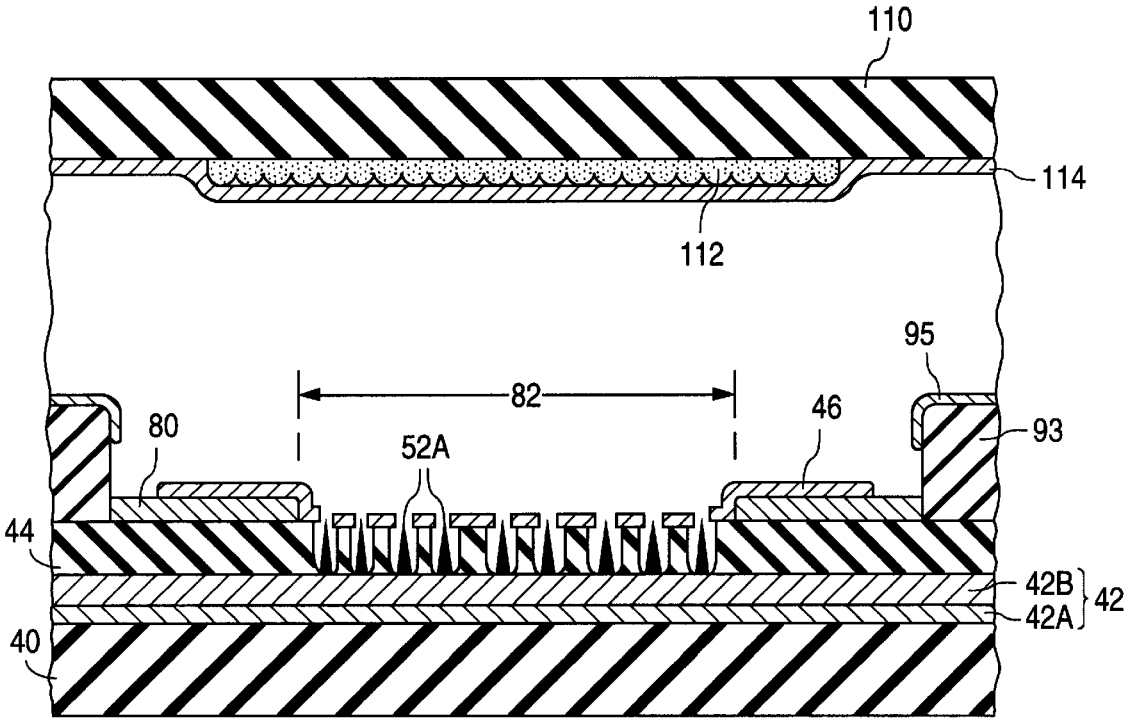
FIG. 6 is a cross-sectional structural view of a flat-panel CRT display that includes a gated field emitter having electron-emissive elements fabricated in accordance with the invention.

FIG. 6 depicts a typical example of the core active region of a flat-panel CRT display that employs an area field emitter, such as that of FIG. 2*d* or 4*e*, manufactured according to the invention. Substrate 40 forms the backplate for the display. Lower non-insulating region 42, situated along the interior surface of backplate 40, here consists specifically of emitter electrodes 42A and an overlying electrically resistive layer 42B. One main control electrode 80 is depicted in FIG. 6.

A transparent, typically glass, faceplate 110 is located across from baseplate 40. Light-emitting phosphor regions 112, one of which is shown in FIG. 6, are situated on the interior surface of faceplate 110 directly across from corresponding control apertures 82. A thin light-reflective layer 114, typically aluminum, overlies phosphor regions 112 along the interior surface of faceplate 110. Electrons emitted by electron-emissive elements 52A pass through light-reflective layer 114 and cause phosphor regions 112 to emit light that produces an image visible on the exterior surface of faceplate 110.

The core active region of the flat-panel CRT display typically includes other components not shown in FIG. 6.

For example, a black matrix situated along the interior surface of faceplate 110 typically surrounds each phosphor region 112 to laterally separate it from other phosphor regions 112. Spacer walls are utilized to maintain a relatively constant spacing between backplate 40 and faceplate 110.

When incorporated into a flat-panel CRT display of the type illustrated in FIG. 6, a field emitter manufactured according to the invention operates in the following way. Light-reflective layer 114 serves as an anode for the field-emission cathode. The anode is maintained at high positive potential relative to the composite control electrodes 46/80 and emitter electrodes 42A.

When a suitable potential is applied between (a) a selected one of emitter electrodes 42A and (b) a selected one of column electrodes 46/80, the so-selected gate portion 46 extracts electrons from the electron-emissive elements at the intersection of the two selected electrodes and controls the magnitude of the resulting electron current. Upon being hit by the extracted electrons, phosphor regions 112 emit light.

Directional terms such as "lower" and "top" have been employed in describing the present invention to establish a frame of reference by which the reader can more easily understand how the various parts of the invention fit together. In actual practice, the components of an electron-emitting device may be situated at orientations different from that implied by the directional terms used here. The same applies to the way in which the fabrication steps are performed in the invention. Inasmuch as directional terms are used for convenience to facilitate the description, the invention encompasses implementations in which the orientations differ from those strictly covered by the directional terms employed here.

While the invention has been described with reference to particular embodiments, this description is solely for the purpose of illustration and is not to be construed as limiting the scope of the invention claimed below. For example, features other than a base focusing structure and possibly an overlying focus coating can be formed over the partially finished field emitter after patterning excess emitter-material layer 52B to form islands 52C but before removing islands 52C. Techniques other than lift-off and electrochemical removal can be utilized to remove islands 52C.

The masked etch of blanket excess emitter-material layer 52B can be performed in such a way that substantially all, rather than just part, of each main control electrode 80 is covered with excess emitter material 52C, all of the excess emitter material being removed from the areas between control electrodes 80. The electrochemical removal procedure of the invention may be performed long enough to create openings through patterned excess-emitter material layer 52C for exposing electron-emissive cones 52A but not long enough to remove all of layer 52C. By combining the two preceding variations, the remaining excess emitter material situated on control 80 can serve as parts of electrodes 80 to increase their current-conduction capability.

Techniques other than a masked etch can be employed in patterning excess emitter-material layer 52B to form islands 52C. For instance, before depositing the emitter material to create cones 52A and excess layer 52B, portions of a readily removable material such as photoresist can be provided over the areas of the field emitter where the portions of excess layer 52B are to be removed in defining islands 52C. After depositing the emitter material, the readily removable material is removed to remove (i.e., lift off) the overlying portion of layer 52B, thereby leaving islands 52C.

The processes of FIGS. 2 and 4 can be revised to make electron-emissive elements of non-conical shape. As an example, deposition of the emitter material can be terminated before fully closing the openings through which the emitter material enters dielectric openings 52. Electron-emissive elements 52A are then formed generally in the shape of truncated cones.

It may be desirable that electron-emissive cones have tips formed with emitter material, such as refractory metal carbide, that cannot readily be directly electrochemically removed. Titanium carbide is an attractive refractory carbide for the tips of the electron-emissive cones. In such a case, electrically non-insulating emitter material (such as molybdenum) that can be electrochemically removed is deposited over the top of the structure at the stage shown in FIG. 2*a* or 4*a* and into dielectric openings 50 to form truncated conical bases for electron-emissive elements. The cone formation process is then completed by depositing the non-electrochemically removable material on top of the structure and into openings 50 until the apertures through which the material enters openings 50 fully close.

An electrochemical removal operation is then performed in the manner described above to remove the excess electrochemically removable emitter material situated directly on composite control electrodes 46/80. During this operation, the excess non-electrochemically removable emitter material located along the top of the structure is lifted off. Consequently, conical electron-emissive elements having bases of electrochemically removable emitter material and tips of non-electrochemically removable emitter material are exposed through gate openings 48.

The electron emitters produced according to the invention can be employed in flat-panel devices other than flat-panel CRT displays. Various modifications and applications may thus be made by those skilled in the art without departing from the true scope and spirit of the invention as defined in the appended claims.

We claim:

1. A method comprising the steps of:

providing an initial structure in which a group of control electrodes overlie a dielectric layer, a multiplicity of electron-emissive elements comprising electrically non-insulating emitter material are respectively situated largely in dielectric openings extending through the dielectric layer and are exposed through control apertures extending through the control electrodes, and an excess layer comprising the emitter material overlies the control electrodes and portions of the dielectric layer in spaces between the control electrodes;

initially removing portions of the emitter material of the excess layer overlying the dielectric layer in the spaces between the control electrodes; and subsequently removing portions of the emitter material of the excess layer overlying the control electrodes above the electron-emissive elements so as to expose the electron-emissive elements.

2. A method as in claim 1 wherein the initially removing step is performed with etchant that directly attacks the emitter material of the excess layer.

3. A method as in claim 2 wherein the etchant is brought largely simultaneously into contact with largely all external surface area of the excess layer where material of the excess layer is removed during the initially removing step.

4. A method as in claim 2 wherein the initially removing step is performed with an etch mask that protects certain of the emitter material of the excess layer.

5. A method as in claim 1 wherein the providing step entails depositing the emitter material (a) into the dielectric openings to at least partially form the electron-emissive elements and (b) over the control electrodes and over the dielectric layer in the spaces between the control electrodes to at least partially form the excess layer.

6. A method as in claim 1 further including, between the removing steps, the step of forming at least part of at least one additional feature over the dielectric layer in the spaces between the control electrodes.

7. A method as in claim 1 further including, between the removing steps, the step of forming portions of a focusing structure over the dielectric layer in the spaces between the control electrodes.

8. A method as in claim 7 further including the step of creating a focus coating of electrically conductive focus material over the focusing structure.

9. A method as in claim 1 wherein each electron-emissive element not electrically shorted to any control electrode is not significantly attacked during the subsequently removing step.

10. A method as in claim 9 wherein the subsequently removing step is performed electrochemically.

11. A method as in claim 9 wherein:

the providing step includes providing the initial structure with a lift-off layer situated at least between (a) the control electrodes and (b) the emitter material of the excess layer overlying the control electrodes; and the subsequently removing step entails removing the lift-off layer to at least remove part of the emitter material of the excess layer overlying the control electrodes.

12. A method as in claim 11 wherein the subsequently removing step is performed with etchant that readily penetrates the excess layer to attack the lift-off layer.

13. A method as in claim 1 wherein:

the providing step entails providing the initial structure with an electrically non-insulating gate layer largely adjoining the control electrodes, extending into the spaces between the control electrodes, and underlying the excess layer;

each electron-emissive element is exposed through a gate opening extending through the gate layer; and the dielectric openings are allocated into a plurality of laterally separated sets of the dielectric openings, each control aperture located above a different one of the sets of dielectric openings.

14. A method as in claim 13 wherein the gate layer substantially fully laterally spans each control aperture.

15. A method as in claim 13 wherein, prior to the initially removing step, the gate layer is largely a blanket layer except for the gate openings.

16. A method as in claim 13 further including, between the removing steps, the step of removing portions of the gate layer overlying the dielectric layer in the spaces between the control electrodes, each control electrode and remaining adjoining material of the gate layer forming at least part of a composite control electrode.

17. A method as in claim 16 wherein:

the gate layer partially overlies the control electrodes; and the excess and gate layers are provided with generally similar patterns during the first two of the removing steps.

18. A method as in claim 13 wherein the providing step entails providing the initial structure with a lower electrically non-insulating region comprising a group of emitter electrodes that cross under the control electrodes, one of the control apertures of each control electrode overlying each emitter electrode.

19. A method as in claim 1 wherein:

each control electrode comprises a main control electrode and at least one adjoining gate portion;

each electron-emissive element is exposed through a gate opening extending through one of the gate portions;

the dielectric openings are allocated into a plurality of laterally separated sets of the dielectric openings; and each control aperture extends through one of the main control electrodes above a different one of the sets of dielectric openings.

20. A method as in claim 19 wherein the gate portions substantially fully laterally span the control apertures.

21. A method as in claim 19 wherein there are a like plurality of gate portions, each substantially fully laterally spanning a different one of the control apertures.

22. A method as in claim 19 wherein the providing step entails providing the initial structure with a lower electrically non-insulating region comprising a group of emitter electrodes that cross under the main control electrodes, one of the control apertures of each main control electrode overlying each emitter electrode.

* * * * *